United States Patent [19]

Sternlieb

[11] 4,026,129

[45] May 31, 1977

[54] DIMENSIONALLY STABLE FABRIC

[76] Inventor: Herschel Sternlieb, 18 Strawberry Hill Road, Andover, Mass. 01810

[22] Filed: July 7, 1975

[21] Appl. No.: 593,702

Related U.S. Application Data

[63] Continuation-in-part of Ser. No. 452,814, March 20, 1974, abandoned.

[52] U.S. Cl. ..... 66/192; 66/85 A; 66/202

[51] Int. Cl.[2] ..... C04B 23/08; C04B 23/10; D04B 7/12

[58] Field of Search ..... 28/77; 66/85 A, 202, 66/192

[56] References Cited

UNITED STATES PATENTS

| | | | |
|---|---|---|---|
| 2,297,440 | 9/1942 | Szucs | 66/85 A |
| 3,405,674 | 10/1968 | Coates et al. | 28/77 X |
| 3,457,738 | 7/1969 | Book et al. | 66/202 X |
| 3,565,025 | 2/1971 | Owen | 66/85 A |
| 3,664,157 | 5/1972 | Kochta et al. | 28/77 X |
| 3,769,816 | 11/1973 | Ploch et al. | 66/85 A |
| 3,819,469 | 6/1974 | Balch | 66/85 A |
| 3,835,512 | 9/1974 | Piller | 66/202 X |

FOREIGN PATENTS OR APPLICATIONS

| | | | |
|---|---|---|---|
| 900,056 | 12/1953 | Germany | 66/85 A |

*Primary Examiner*—Louis K. Rimrodt
*Attorney, Agent, or Firm*—Pearson & Pearson

[57] ABSTRACT

A dimensionally stable, padded, fabric of the type having a layer of carded, fibers reinforced by a woven fabric layer, warp knitted together by separate yarns is characterized by the carded fiber layer being unbonded, uncompacted and of intermingled, non-parallel fibers. Also by the woven fabric base layer being a fine mesh, thin, strong, tightly woven scrim of spun polyester fibers in the range of 28s to 40s. Also by the warp knit yarns being spun polyester fibers in the range of 16s to 24s. The knit yarns are embedded in the soft exposed batting face but are on the surface of the exposed scrim face to give that face high abrasion resistance.

6 Claims, 7 Drawing Figures

DIMENSIONALLY STABLE FABRIC

RELATED APPLICATION

This application is a continuation-in-part of U.S. patent application Ser. No. 452,814 of Herschel Sternlieb filed Mar. 20, 1974, now abandoned.

BACKGROUND OF THE INVENTION

It has heretofore been proposed to hook, or knit a carded fiber batt, or roving, to a reinforcing woven fabric base by punching fibers of the batt through the layers or knitting separate yarns therethrough. The woven fabric has been "burlap" as in U.S. Pat. No. 2,580,089 to Grant of 1951, or in U.S. Pat. No. 1,816,416 to Willingham of 1931, and has been "cheese-cloth" as in U.S. Pat. No. 2,672,673 to Shaw of 1954.

In German Pat. No. 900,056 to Dilo of 1953, a plurality of wales of chain stitches appear on the face of the textile base but the wales are not connected. On the other hand, in U.S. Pat. No. 3,457,738 to Book of 1969 a batting is disclosed as the base, there being a plurality of chain loops on one side and nubs on the other side but no woven reinforcing fabric.

As far as we are aware there has been no teaching in the prior art of a composite, unitary, dimensionally-stable, fabric formed by tricot stitching a tight woven synthetic fabric to a batting of cardable fibers to produce a thin, cloth-like material of substantially uniform cross section especially useful for bedspreads, or for the uppers of foot gear such as sneakers, athletic shoes, etc.

SUMMARY OF THE INVENTION

In this invention the batting is formed of any cardable fibers and is a web of predetermined width and uncompacted, fluffy, unbonded, thickness of about one quarter of an inch. The fibers are intermingled and about one to two inches in length. Preferably the fibers are hydrophillic with good wicking quality. The woven, reinforcing, or base, fabric is preferably of spun, synthetic, fibers such as a polyester, of the "scrim" type and comprising a light weight, open, mesh relatively tight weave of from 15 to 25 yarns per inch warp-wise and weft-wise. The yarns range from about 28 singles to 40 singles. The tricot knit yarns are of synthetic material such as a polyester and range from 16 singles to 24 singles, the stitches being spaced about 12 stitches per inch.

Because of the relatively fine mesh of the warp and filling yarns of the woven scrim layer, and the pattern of the tricot knit yarns on the exposed surface of the scrim layer, the fibers of the batting are not only substantially hidden well below the plane of the polyester yarns but are inhibited from protruding through.

Thus the polyester yarn face of the woven scrim, and the zig-zag laps, or floats, of the knitting yarns present a highly abrasion resistant surface on the scrim side of the material. On the other opposite face, however, which is devoid of woven scrim, the soft warm fibers of the batting, embed the relatively harsh spun polyester yarns of the tricot knit to present an exposed surface pleasant to the touch.

The term "singles" as used herein means single yarns made up of twisted fibers. Plied yarns are made up of twisted singles and cords are made up of twisted "plies."

DESCRIPTION OF THE PREFERRED EMBODIMENT

Figure 1:
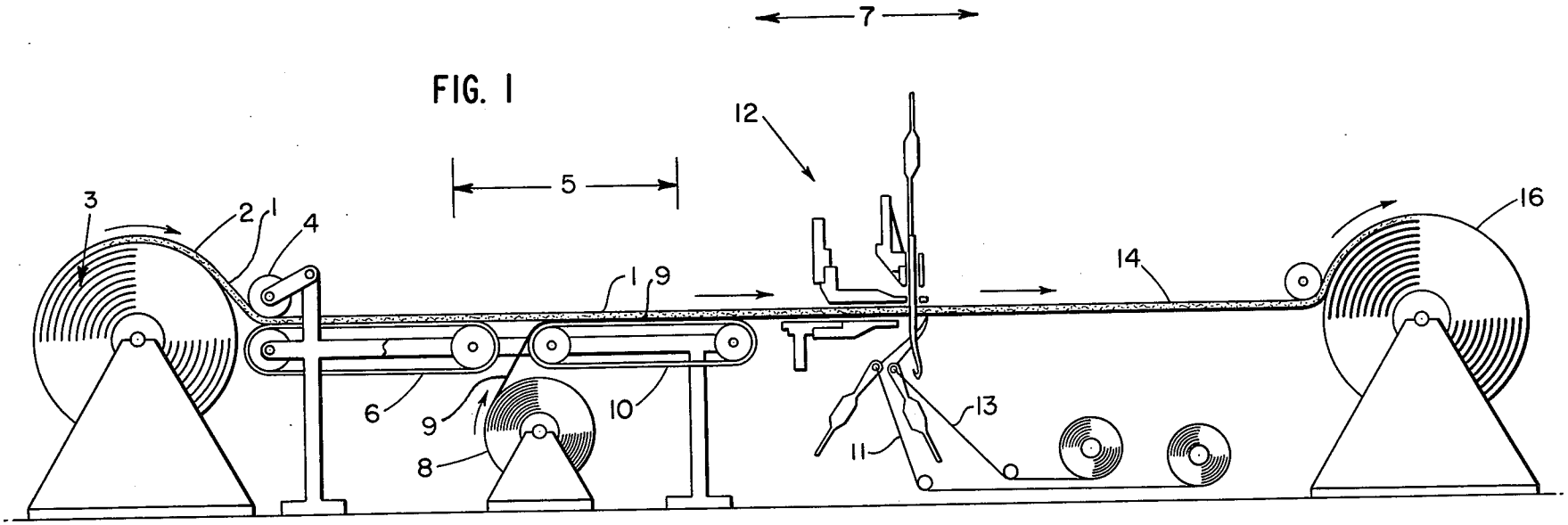
FIG. 1 is a schematic side elevational view of an apparatus for manufacturing the improved fabric of this invention.
Figure 2:
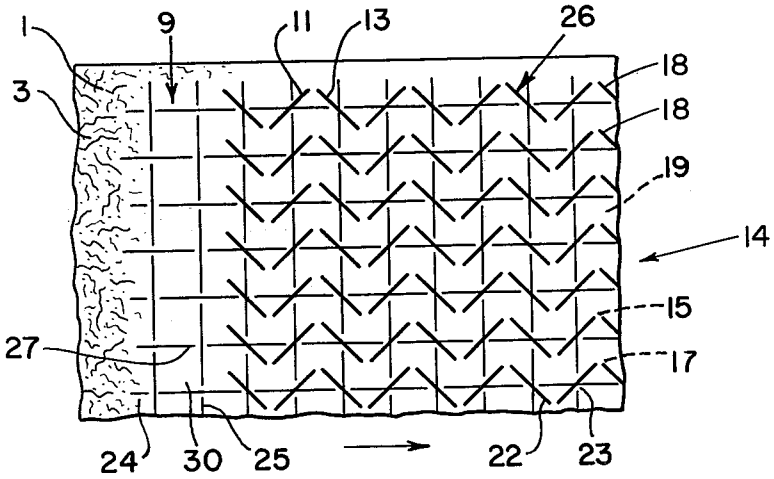
FIG. 2 is an enlarged schematic plan view of the fabric of the invention.
Figure 3:
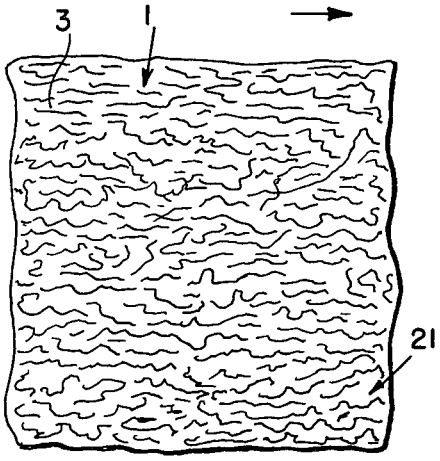
FIG. 3 is a still further enlarged top plan view of the carded batt layer before incorporation into the fabric of the invention.
Figure 4:
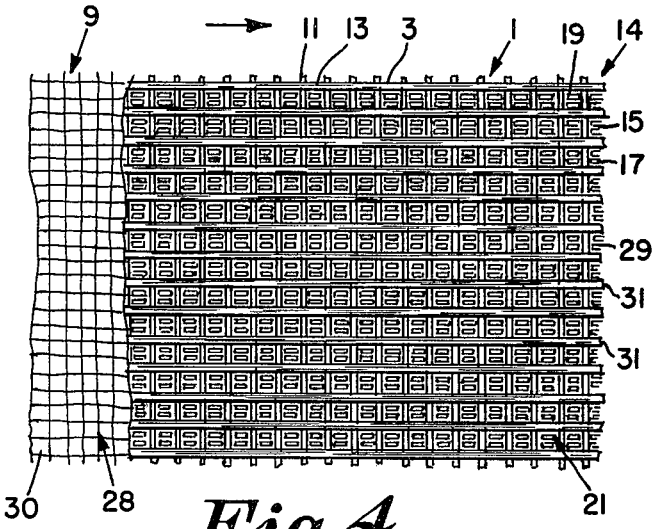
FIG. 4 is a view similar to FIG. 3 with parts broken away showing the fabric of the invention.
Figure 5:
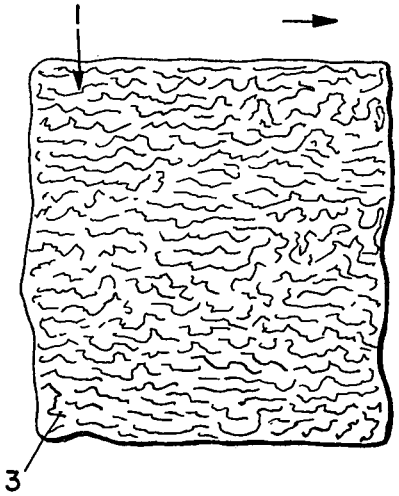
FIG. 5 is a bottom plan view of the carded web.
Figure 6:
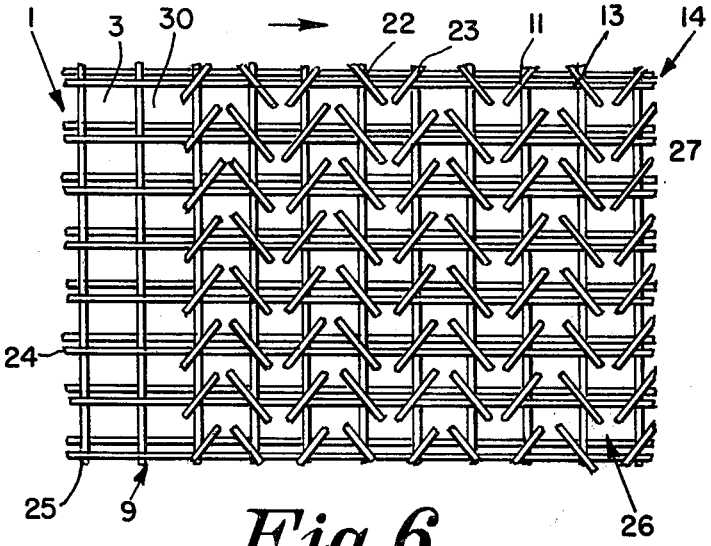
FIG. 6 is a bottom plan view, with parts broken away showing the fabric of the invention.
Figure 7:
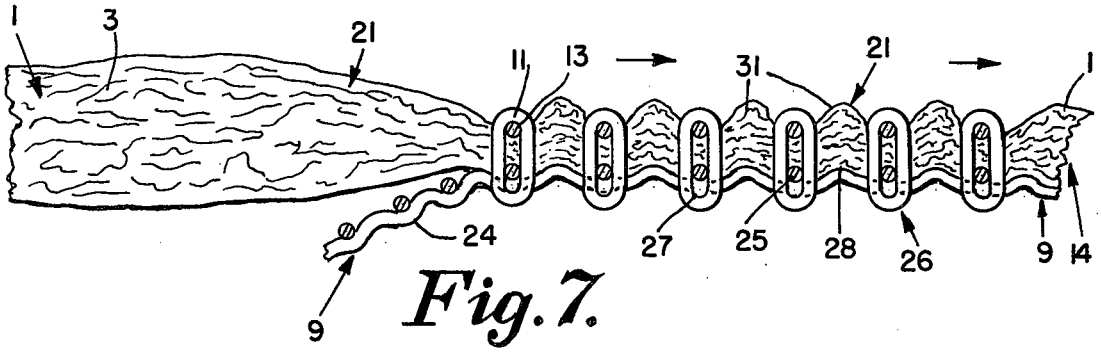
FIG. 7 is a further enlarged side elevation schematically showing in section the fabric of the invention.

Referring to FIG. 1 a web 1, of any suitable cardable fibers, whether natural or synthetic, such as a modacrylic, or cotton, wool, nylon, etc., and less than one inch in thickness, preferably ranging between about one-eighth of an inch to one-half inch in thickness, and in unbonded, uncompacted condition is supplied from a web feed roller 2. The web 1 is preferably formed of fibers about one to two inches in length, which are intermingled, and non-parallel, and waste fibers, noils and the like are not usable in the system of the invention. Preferably the fibers 3 of the carded web 1 are hydrophillic with good wicking qualities to assist in carrying off perspiration when the fabric of the invention is used as the upper for sneakers, athletic shoes or the like.

The carded web 1 advances in the direction of the arrows, from guide roll 4, thence supported on suitable endless conveyors 6 and 10, through a scrim zone 5, a stitching zone 7 to a wind-up roll 16 having suitable take-up mechanism not shown.

In scrim zone 5, a web 9 of light weight, fine mesh, relatively strong backing, or reinforcing woven fabric is continuously supplied from the supply roll 8 to under lie the carded web 1 on the endless conveyor 10. The scrim 9 is a tightly woven fabric of spun polyester yarns in the range of 28s to 40s, permitting the scrim to breathe but having mesh 30 small enough to prevent the fibers of the web 1 from protruding therethrough. Thus, the weave is described as open, but just barely open and not of the burlap or cheesecloth type because one of the objects of this invention is to provide a high percentage such as 70–80% yarn surface on the scrim side for abrasion resistance purposes, while having about 20% open area for breathing. Fifteen to twenty-five yarns per inch both warp-wise and weft-wise has been found to give excellent results.

The composite fabric, with carded web in uncompacted, unbonded form supported on the tight woven, but open mesh, scrim fabric 9 then passes through stitch bonding zone 7 where at least two knitting yarns 11 and 13, are stitched through both layers with a tricot stitch 18 by a warp knitting machine 12. Knitting machine 12 may be of any well known type such as a or "Arachne" machine. An interlocking chain stitch is thus formed "Maliwat" with the parallel wales 15 and 17 of chain stitches 19 embedded in the exposed soft surface 21 of the web 1 and the zig-zag laps 22 and 23 overlying the warp yarns 24 and weft yarns 25 of woven scrim 9 on the exposed abrasion resistant surface 26 of the scrim 9.

The knitting yarns 11 and 13 are preferably spun polyester, and highly abrasive resistant, like the spun polyester yarns of the woven scrim 9, so that they not only prevent protrusion of the batt fibers but the criss-cross lap, or float, portions 22 and 23, and the weave intersections 27 are the portions which touch any wearing surface. Knitting tension is adjusted to compress the batt 1 down, from its fluffy, uncompacted condition, along the parallel wales 15, 17 of chain stitches 19 to proximate the plane of the adjacent face 28 of the scrim 9 thereby forming longitudinally extending grooves 29 and longitudinally extending ribs, 31 in the soft surface 21.

Preferably the scrim web 9 is slightly wider than the carded web 1 when fed into machine 12 to form the fabric 14 of the invention.

In a preferred embodiment of the invention, the batt is a carded web of modacrylic fiber with a density ranging between 2 to 11 ounces per square yard and preferably about 3 ounces per square yard of intermingled fibers 1 to 2 inches in length. The scrim is formed of spun, polyester warp and filling yarns with a density of about 1.75 ounces per square yard, the open mesh being formed by yarns at 15–25 strands per inch and the yarns ranging between 28 singles and 40 singles. The knit yarns are spun polyester with a density of about 2 ounces per square yard, the yarns ranging between 16 singles and 24 singles and there being about 12 gauge, 12 stitches per inch. The fabric makes a heavy one piece sneaker with excellent ventilating qualities, soft and comfortable next to the skin and tough and abrasion resistant on the outside.

It has been found that by employing a 36 sley scrim 9 of a color differing from the color of the carded fiber web 1 that a stitch bonded fabric having a denim-like appearance is thereby produced.

If a polyester filament or spun thread having a density of 2 ounces per square yard or less is employed to tightly stitch a web comprising a modacrylic fiber of a density of 3 ounces per square yard or more to a polyester scrim having a 36 sley mesh and a density of approximately 1.75 ounces per square yard, during the stitch bonding operation, at a gauge of approximately 12 stitches per inch, a nonflammable fabric having all of the above qualities is produced. This fabric is ideally suited for use as a bedspread material.

I claim:

1. A dimensionally stable, composite fabric comprising:

a carded layer of intermingled, unbonded fibers, of about one to two inches in length, said layer being normally uncompacted, and about one eighth inches to one half inch in thickness and having a density of about 3 ounces per square yard;

a layer of woven scrim fabric formed of spun polyester warp and weft yarns in the range of 28 singles to 40 singles, said fabric being light weight, open mesh, woven at about 15–25 strands per inch and having a density of about 1.75 ounces per square yard;

said carded fiber layer being superposed on said woven scrim layer to form a composite fabric and a multiplicity of tricot knit stitches joining said layers into a unitary fabric, said stitches being formed of spun polyester yarns in the range of 16 singles to 24 singles, and being about 12 gauge 12 stitches per inch with a density of about 2 ounces per square yard, said stitches being at predetermined tension with the chain stitch wales thereof embedded below the plane of the exposed face of said cardable fiber layer and compacting said layer down toward the plane of said woven fabric while forming a plurality of soft, elongated fibrous ribs on each side of, and in parallelism with, said wales;

and zig-zag laps of said tricot stitches overlying the exposed woven polyester yarn face on the opposite side of said fabric to increase the abrasion resistance thereof.

2. A composite fabric as specified in claim 1 wherein:

said woven fabric layer is wider than said carded fiber layer.

3. A composite fabric as specified in claim 1 wherein:

said scrim layer is woven with a sley of about 36 yarns per inch in a color differing from the color of the carded fiber layer;

whereby said fabric has a denim-like appearance.

4. A composite fabric as specified in claim 1 wherein:

said scrim layer is woven with a sley of about 36 yarns per inch and the fibers of said carded layer are modacrylic whereby a substantially nonflammable fabric is produced suitable for use in bedspreads.

5. A dimensionally stable composite fabric of the type having a carded fiber batting stitch bonded to a woven fabric backing by a plurality of knit stitches characterized by the woven fabric being tightly woven of warp and filling spun polyester yarns in the range of 28 singles to 40 singles at about 15–25 yarns per inch and the stitches are tricot knit at predetermined tension from at least two spun polyester yarns, each in the range of 16 singles to 24 singles and joining said carded fiber layer to said woven fabric at about 12 stitches per inch longitudinally thereof;

the exposed face of said carded fiber layer having the chain stitch wales of said tricot stitches embedded below the plane thereof and compacting said carded fiber layer down to proximate the plane of said woven fabric to form spaced, longitudinally-extending, soft, fibrous ribs spaced apart by longitudinally extending compacted areas and the exposed face of said woven fabric having the zig-zag laps of said tricot stitches overlying the exposed woven polyester yarn face on the opposite side of said fabric to present a highly abrasion resistant surface.

6. A dimensionally stable, composite fabric comprising:

a carded layer of uncompacted, unbonded intermingled fibers superposed flatwise on an open mesh, tightly woven fabric layer of polyester yarns and a plurality of tricot knit stitches, formed of at least two polyester yarns, connecting through said carded fiber layer and said woven fabric layer the loops of said stitches on the carded fiber layer side of said fabric being tensioned to embed therein below the level of the exposed face thereof and form soft fibrous ribs spaced apart by compacted areas;

and the zig-zag laps, or floats, of said tricot stitches on the woven fabric layer side of said fabric overlying the yarns of the weave thereof to increase the abrasion resistance thereof.

* * * * *